US008100186B2

(12) United States Patent
Noel

(10) Patent No.: US 8,100,186 B2
(45) Date of Patent: Jan. 24, 2012

(54) EXPANSION SYSTEM FOR EXPANDABLE TUBULARS AND METHOD OF EXPANDING THEREOF

(75) Inventor: Gregory Marshall Noel, Katy, TX (US)

(73) Assignee: Enventure Global Technology, L.L.C., Houston, TX (US)

( * ) Notice: Subject to any disclaimer, the term of this patent is extended or adjusted under 35 U.S.C. 154(b) by 254 days.

(21) Appl. No.: 12/503,213

(22) Filed: Jul. 15, 2009

(65) Prior Publication Data

US 2011/0011578 A1 Jan. 20, 2011

(51) Int. Cl.

| | |
|---|---|
| ***E21B 19/16*** | (2006.01) |
| ***E21B 23/00*** | (2006.01) |
| ***E21B 43/10*** | (2006.01) |
| ***E21B 40/00*** | (2006.01) |

(52) U.S. Cl. ..... 166/380; 166/206; 166/207; 166/208; 166/217; 72/393

(58) Field of Classification Search ..... 166/380, 166/206, 207, 208, 217, 216; 72/393, 370.06–370.08
See application file for complete search history.

(56) References Cited

U.S. PATENT DOCUMENTS

| | | | | |
|---|---|---|---|---|
| 6,450,261 | B1 * | 9/2002 | Baugh | 166/277 |
| 6,722,427 | B2 | 4/2004 | Gano et al. | |
| 7,410,946 | B2 | 8/2008 | Rayner et al. | |
| 7,513,313 | B2 | 4/2009 | Watson | |
| 7,516,790 | B2 | 4/2009 | Cook | |
| 7,546,881 | B2 | 6/2009 | Lloyd et al. | |
| 7,559,365 | B2 | 7/2009 | Watson | |
| 2003/0196818 | A1 * | 10/2003 | Lynde et al. | 166/382 |
| 2005/0045342 | A1 * | 3/2005 | Luke et al. | 166/384 |
| 2005/0126251 | A1 | 6/2005 | Oosterling et al. | |
| 2005/0194127 | A1 * | 9/2005 | Campo | 166/207 |
| 2007/0114018 | A1 | 5/2007 | Brezinski et al. | |
| 2009/0308594 | A1 | 12/2009 | Lohbeck | |
| 2010/0193199 | A1 | 8/2010 | Lohbeck | |

* cited by examiner

*Primary Examiner* — Shane Bomar
*Assistant Examiner* — Cathleen Hutchins
(74) *Attorney, Agent, or Firm* — Edmonds & Nolte, PC; Derek V. Forinash

(57) ABSTRACT

Methods and apparatus for radially expanding and plastically deforming an expandable tubular member using a lower expansion cone and an upper expandable cone. The apparatus includes an expandable tubular, a support member releasably secured to the expandable tubular, and an extendable section below where the support member is releasably anchored. An upper expandable cone is attached to the extendable section and in a retracted state and an anchor is disposed below the upper expandable cone. The anchor is releasable from below the upper expandable cone. A lower expansion cone is disposed below the anchor. An expansion sleeve is disposed in the lower end of the expandable tubular. The lower expansion cone is configured to expand the expansion sleeve radially outward to an outer diameter greater than the inside diameter of the expandable tubular when axially displaced downward by the extendable section.

18 Claims, 2 Drawing Sheets

EXPANSION SYSTEM FOR EXPANDABLE TUBULARS AND METHOD OF EXPANDING THEREOF

BACKGROUND

In the oil and gas industry, expandable tubing is often used for casing, liners and the like. To create a casing, for example, a tubular member is installed in a wellbore and subsequently expanded by displacing an expansion cone through the tubular member. The expansion cone maybe pushed or pulled using mechanical means, such as by a support tubular coupled thereto, or driven by hydraulic pressure. As the expansion cone is displaced axially within the tubular member, the expansion cone imparts radial force to the inner surface of the tubular member. In response to the radial force, the tubular member plastically deforms, thereby permanently increasing both its inner and outer diameters. In other words, the tubular member expands radially. Expandable tubulars may also be used to repair, seal, or remediate existing casing that has been perforated, parted, corroded, or otherwise damaged since installation.

DETAILED DESCRIPTION

The present disclosure relates to apparatus and methods for expanding a tubular within a wellbore. In some embodiments, a first expansion cone is used to expand the lower end of a tubular before a second expansion cone expands at least a portion of the tubular.

Figure 1A:
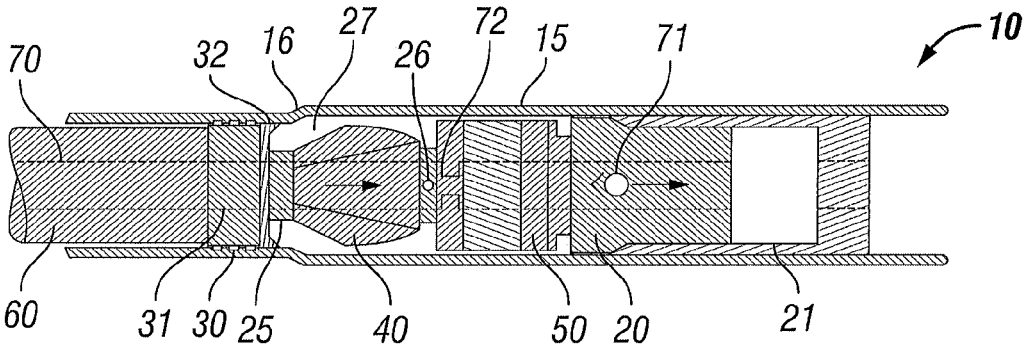
FIGS. 1A-1E are schematic illustrations of an expansion apparatus at various steps in an expansion process in accordance with one embodiment.

Referring to FIG. 1A, an embodiment of an expansion apparatus 10 for radially expanding and plastically deforming a tubular member 15 is shown in a running position. The expansion apparatus 10 includes a tubular support member 60 that includes an extendable section 25, which may be, for example, a bumper sub, slack joint, or hydromechanical actuator configured to act downwardly. A releasable anchor 31 is located above the extendable section 25, and may be anchored to the expandable tubular 15 using a profile 30 formed inside the expandable tubular 15. An upper expandable cone 40, an anchor 50, and a lower expansion cone 20 are located below the extendable section 25. The lower expansion cone 20 fits partially within an expansion sleeve 21. The individual components in the expansion apparatus may include an inner bore 70 to allow fluid pumped from the surface to pass through the expansion apparatus 10 and exit through the expansion sleeve 21. The fluids may be hardenable, such as cement, or non-hardenable, such as drilling mud. The lower expansion cone 20 and/or the expansion sleeve 21 may include a check valve 71

The expansion apparatus 10 in the running position is located at a selected location in a wellbore before beginning the expansion process. Once on depth, cement or other hardenable fluid can be pumped through the expansion apparatus 10, followed by a wiper dart or ball (not shown) to clean the cement and provide a pressure plug within or above the lower expansion cone 20. A seat 72 may be located above the check valve 71 and below a port 26 to provide a pressure plug to initiate expansion using the wiper dart or ball. Although shown with an upset 16 prior to expansion, the expandable tubular 15 may instead have a constant outside diameter before expansion according to various design considerations while designing the wellbore. The first step of expansion is to downwardly displace the lower expansion cone 20 into the expansion sleeve 21. If the extendable section 25 is a bumper sub, fluid may be pumped through the port 26 below the upper expandable cone 40. Port 26 may be initially sealed with a rupture disk that ruptures in response to pressure buildup after seating of the dart or ball in seat 72. A seal 32, such as a cup sub, above the extendable section 25 seals the annulus between the support member 60 and the expandable tubular 15 to provide a fluid chamber 27 above the lower expansion cone 20. Fluid pumped into fluid chamber 27 forces the lower expansion cone 20 downward into the expansion sleeve 21, which radially expands to accommodate the lower expansion cone 20 therein. The expansion sleeve 21 is not substantially compressible and may be made of a polymer material, such as polyurethane. Forcing the expansion sleeve 21 outward expands the lower section of the expandable tubular 15. To stay in place axially relative to the expandable tubular 15, the expansion sleeve 21 may have a higher friction coefficient on its outer diameter than on its inside diameter, which causes the expansion sleeve 21 to grip the inside of the expandable tubular 15 while allowing the lower expansion cone 20 inside the expansion sleeve 21.

Figure 1B:
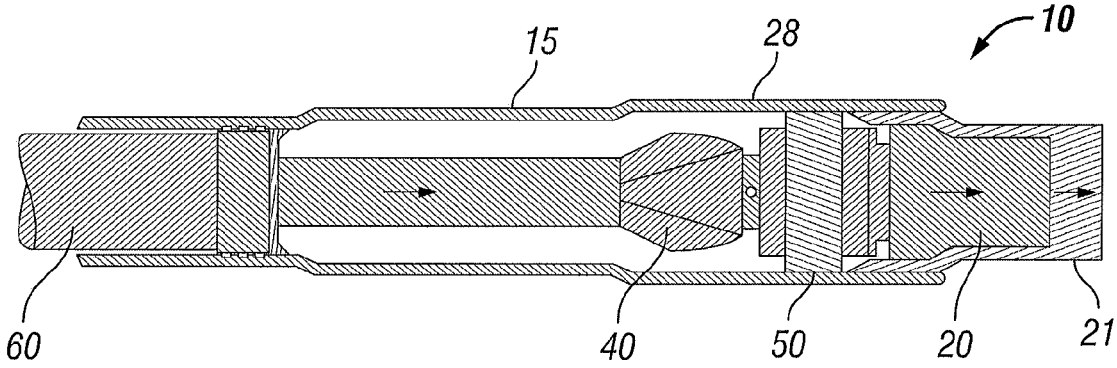

FIG. 1B shows the expansion apparatus 10 after expanding the lower end of the expandable tubular 15. After partial expansion of the lower end, the lower expansion cone 20 axially displaces the end of the expansion sleeve 21 to continue expansion until the end of the expandable tubular 15 is radially expanded. In one embodiment, downward expansion may continue until the lower expansion cone 20 and expansion sleeve 21 are partially or fully extruded off the expandable tubular 15. The downward expansion process creates a launcher portion 28 at the lower end of the expandable tubular 15. The upper expandable cone 40 and the anchor 50 move axially with the extendable section 25 and the lower expansion cone 20 during the downward expansion such that they are located within the launcher portion 28 of the expandable tubular 15 after completion of the downward expansion. Anchor 50 may then be actuated to anchor within the launcher portion 28 of the expandable tubular 15. Anchor 50 may be, for example, a hydraulically actuated packer that sets in response to increased pressure from fluid pumped into the expansion apparatus 10.

Figure 1C:
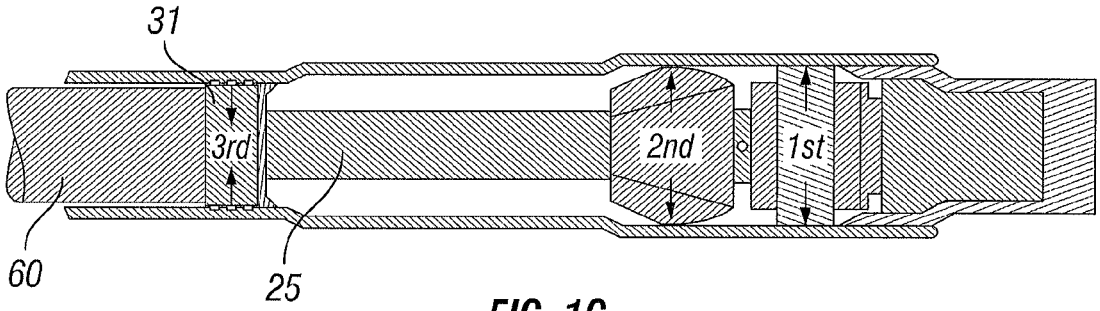

Turning to FIG. 1C, the upper expandable cone 40 is expanded to increase its outer diameter to about the inside diameter of the launcher portion 28. As with anchor 50, the upper expandable cone 40 may actuate in response to pressure from fluid pumped into the expansion apparatus 10. Because of the earlier downward expansion, the upper expandable cone 40 is able to freely expand to a greater diameter without the force that would be required to simultaneously expand the expandable tubular 15. Releasable anchor 31 is released to allow axial movement of support member 60 and expansion of the upper portion of the expandable tubular 15. In one embodiment, releasable anchor 31 may be configured to automatically release during downward expansion when extendable section 25 extends to a selected length. Although FIG. 1C shows the anchor 50, upper expandable cone 40, and releasable anchor 31 actuated sequentially, the disclosure is not limited to a particular order of actuation between those components.

Figure 1D:
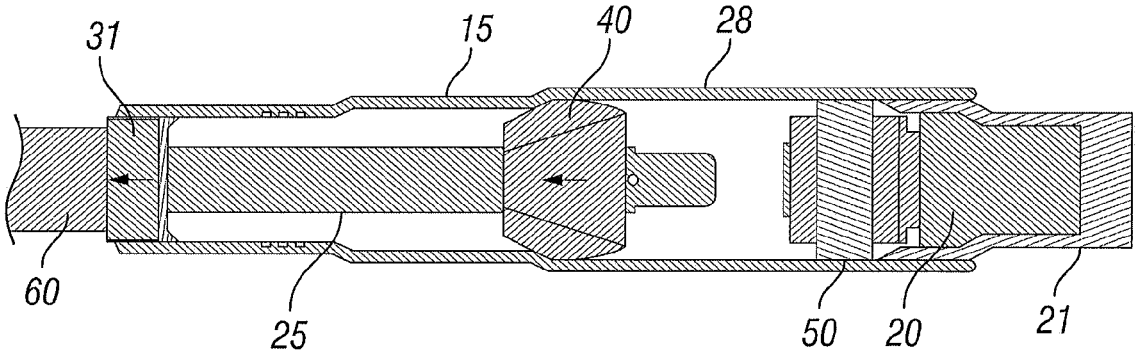

FIG. 1D shows the upper expansion process after releasing from anchor 50. The anchor 50 may be releasably axially secured below the upper expandable cone 40 by shear pins or other releasable mechanisms. The upward force to release from anchor 50 may be provided by pulling upward on the support member 60 from the surface or by pressure from fluid pumped into the launcher portion 28 above anchor 50, or a combination thereof. The upper expandable cone 40 is pushed upward beyond launcher portion 28 by pressure from fluid pumped below the upper expandable cone 40 and/or pulled upward by support member 60. Anchor 50 maybe used to provide a seal below the upper expandable cone 40 to allow pressure buildup to drive the upward expansion. In one embodiment, the extendable section 25 is a dual acting actuator that pulls upward on the expandable cone 40 during upward expansion.

Figure 1E:
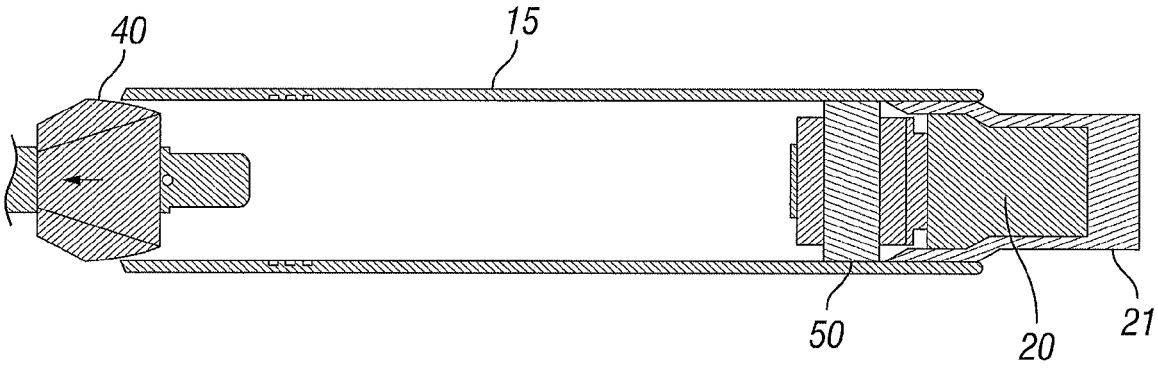

Upward expansion continues as shown in FIG. 1E until the expandable tubular 15, or a desired portion thereof, is expanded. The anchor 50, lower expansion cone 20, and expansion sleeve 21 are left in the end of the expanded tubular 15 to be drilled out at a later time. The materials for the anchor 50 and lower expansion cone 21 may be selected to be easily drillable. Drillable materials include cast iron, aluminum, plastic, ceramic, aluminum-bronze, or other materials depending on the expansion force required to expand the lower portion of the expandable tubular. For the anchor 50, drillable packers are commercially available from multiple companies, such as TIW Corporation (Houston, Tex.). To aid drilling, the lower expansion cone 20 and expansion sleeve 21 may further include anti-rotation features, such as grooves or knurled surfaces, to prevent relative rotation between each component and the expanded tubular 15 while drilled out. For example, in one embodiment, the bottom of the expansion sleeve may include protrusions that engage the bottom of the wellbore and the bottom of the lower expansion cone 20 may include protrusions that engage the expansion sleeve 21. After drilling out the components left in the expanded tubular 15, a single diameter liner is provided in the wellbore.

Embodiments of the disclosure create a launcher portion in situ, which allows for the outer diameter of the lower portion of the expandable tubular to be the same or only slightly larger than the rest of the expandable tubular. This reduces the risk of the expansion apparatus being stuck within the wellbore before reaching the desired location and allows the expansion apparatus to be run through liners or casing with inside diameters that are equal or only slightly greater than what the outside diameter of the expandable tubular will be after expansion by the upper expandable cone.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. An expansion apparatus, comprising:

an expandable tubular;

a support member releasably secured to the expandable tubular, wherein the support member includes an extendable section below where the support member is releasably secured to the expandable tubular;

an upper expandable cone coupled to the extendable section and in a retracted state;

an anchor releasably coupled to the extendable section below the upper expandable cone;

a lower expansion cone coupled to the extendable section below the anchor; and a resilient sleeve disposed in the lower end of the expandable tubular, wherein the extendable section is operable to move the lower expansion cone downward so as to expand the resilient sleeve and the expandable tubular radially outward to form a launcher portion on the lower end of the expandable tubular, wherein said anchor is operable to sealingly engage the launcher portion.

2. The apparatus of claim 1, further comprising:

a seal between the support member and the inside of the expandable tubular above the extendable section.

3. The apparatus of claim 2, wherein the extendable section is a bumper sub.

4. The apparatus of claim 1, wherein the extendable section is a hydromechanical actuator.

5. The apparatus of claim 1, wherein the anchor, the lower expansion cone, and the expansion sleeve are drillable.

6. The apparatus of claim 1, wherein the expansion sleeve has a higher coefficient of friction on the outside diameter than the inside diameter.

7. The apparatus of claim 1, wherein the upper expandable cone expands in response to hydraulic pressure.

8. The apparatus of claim 1, wherein the anchor sets in response to hydraulic pressure.

9. The apparatus of claim 1, wherein the support member is configured to release from the expandable tubular in response to extension of the extendable section.

10. The expansion apparatus of claim 1, wherein the upper expandable cone is operable to move from a retracted state to an extended state when disposed within the launcher portion of the expandable tubular.

11. A method comprising:

locating an expandable tubular and a support member within a wellbore, wherein the support member is releasably secured to the expandable tubular;

downwardly displacing a lower expansion cone into a resilient sleeve to expand a lower portion of the expandable tubular, wherein an anchor and an upper expandable cone disposed above the lower expansion cone downwardly displace with the lower expansion cone;

sealing above the lower expansion cone with the anchor within the expanded lower portion of the expandable tubular;

expanding the upper expandable cone above the anchor within the expanded lower portion of the expandable tubular;

releasing the upper expandable cone from the anchor;

releasing the support member from the expandable tubular; and forcing the expanded upper expandable cone upward to radially expand the expandable tubular above the expanded lower portion.

12. The method of claim 11, further comprising:

drilling out the anchor, the lower expansion cone, and the expansion sleeve from within the expanded tubular.

13. The method of claim 11, wherein the anchor is a packer.

14. The method of claim 11, wherein a bumper sub is disposed at the lower end of the support member above the upper expandable cone.

15. The method of claim 14, wherein the downward displacement of the lower expansion cone is provided by pressurizing a fluid chamber above the lower expansion cone.

16. The method of claim 11, wherein a hydromechanical actuator is disposed at the lower end of the support member above the upper expandable cone.

17. The method of claim 11, wherein the upward expansion by the upper expandable cone is at least partially hydraulically driven by fluid pumped below the upper expandable cone.

18. The method of claim 11, wherein the releasing of the support member is in response to extension of an extendable section disposed at the lower end of the support member above the upper expandable cone.

* * * * *